US008479838B1

(12) United States Patent
Biggs et al.

(10) Patent No.: US 8,479,838 B1
(45) Date of Patent: Jul. 9, 2013

(54) DOZING BLADE ASSEMBLY, CUTTER AND DOZING METHOD

(75) Inventors: Nick W. Biggs, Princeville, IL (US); Thomas M. Congdon, Dunlap, IL (US); Kevin L. Martin, Washburn, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/333,013

(22) Filed: Dec. 21, 2011

(51) Int. Cl.
*E02F 3/80* (2006.01)

(52) U.S. Cl.
USPC ..... 172/701.3; 172/701.1

(58) Field of Classification Search
USPC ..... 172/811, 701.3, 815, 664, 777, 747, 172/701.1; D15/32, 11; 37/266, 404, 264; 144/334
See application file for complete search history.

(56) References Cited

U.S. PATENT DOCUMENTS

| | | | | | |
|---|---|---|---|---|---|
| 2,841,897 | A | | 7/1958 | Duke | |
| 2,959,307 | A | | 11/1960 | Schwartz | |
| 3,016,637 | A | * | 1/1962 | Abel | 172/701.3 |
| 3,238,648 | A | | 3/1966 | Cobb et al. | |
| 3,289,331 | A | * | 12/1966 | Freeman | 172/701.2 |
| 3,528,509 | A | | 9/1970 | Bleyker | |
| 3,559,749 | A | | 2/1971 | Fryrear et al. | |
| 4,390,071 | A | * | 6/1983 | Wright | 172/701.3 |
| 4,991,662 | A | * | 2/1991 | Caron et al. | 172/701.1 |
| 5,392,864 | A | | 2/1995 | Lindenmuth | |
| 6,574,890 | B2 | * | 6/2003 | Bateman, Jr. | 37/264 |
| D477,610 | S | | 7/2003 | Matsumoto et al. | |
| D478,098 | S | * | 8/2003 | Matsumoto et al. | D15/11 |
| 6,938,701 | B2 | | 9/2005 | Matsumoto et al. | |
| 7,013,983 | B2 | | 3/2006 | Matsumoto et al. | |
| D534,929 | S | | 1/2007 | Matsumoto et al. | |
| D538,307 | S | | 3/2007 | Matsumoto et al. | |
| 7,191,846 | B2 | | 3/2007 | Matsumoto et al. | |
| 7,401,658 | B2 | | 7/2008 | Matsumoto et al. | |
| 7,654,336 | B2 | | 2/2010 | Matsumoto et al. | |
| 7,690,441 | B2 | | 4/2010 | Matsumoto et al. | |
| 7,810,581 | B2 | | 10/2010 | Matsumoto et al. | |
| 8,272,451 | B2 | * | 9/2012 | Ditzler | 172/818 |
| 8,291,624 | B2 | * | 10/2012 | Hall | 37/266 |
| 2005/0098332 | A1 | * | 5/2005 | Matsumoto et al. | 172/811 |
| 2005/0211451 | A1 | * | 9/2005 | Matsumoto et al. | 172/811 |
| 2007/0209811 | A1 | * | 9/2007 | Matsumoto et al. | 172/811 |
| 2008/0314607 | A1 | * | 12/2008 | May | 172/701.3 |
| 2010/0031538 | A1 | | 2/2010 | Hall | |

* cited by examiner

*Primary Examiner* — Árpád Fábián-Kovács
(74) *Attorney, Agent, or Firm* — Liell & McNeil

(57) ABSTRACT

A dozing blade assembly includes a dozing blade, and a cutter mounted to the dozing blade. The cutter includes a compound digging face extending between a proximal edge and a distal edge. The compound digging face has a steeply oriented center segment, and shallowly oriented outer segments, for balancing downward penetration with forward pushability during moving the dozing blade assembly through material of a substrate.

20 Claims, 5 Drawing Sheets

DOZING BLADE ASSEMBLY, CUTTER AND DOZING METHOD

TECHNICAL FIELD

The present disclosure relates generally to a dozing blade assembly for a tractor, and relates more particularly to dozing material via a dozing blade assembly having a cutter with a steeply oriented center section and shallowly oriented outer sections.

BACKGROUND

Tractors equipped with dozing blades are used for a great many different purposes. Applications which will be familiar to most include pushing loose material such as landfill trash, construction debris, and soil about a worksite. Such dozing activities are indispensable to forestry, waste handling, building construction, and light to medium civil engineering. Small to mid-sized tractors are commonly used in these industries.

Dozing is also an integral part of larger scale activities such as mining and major civil engineering projects. In these contexts, rather than pushing loose material across a surface, tractors equipped with dozing blades are often used to dig material from a substrate. In the case of rocky terrain, commonly encountered in opencast mines, or where substrate materials otherwise have a high structural integrity, quite large and powerful machines equipped with rugged dozing blades are often required. These and analogous activities are generally referred to as "production dozing." In production dozing, a tractor equipped with a heavy-duty dozing blade is typically driven across, and through, a substrate such that a cutting edge of the dozing blade penetrates downward and forward through the material of the substrate, overcoming the structural integrity of the material, and causing it to fail. In large scale surface mining activities, a tractor, typically equipped with ground engaging tracks, may make successive passes across an area where surface material is to be removed, forming a slot in the substrate in each pass. Due to the harsh environment, frequent repair, replacement, and servicing of the equipment is often necessary. Moreover, to maximize productivity it is often desirable to employ machine operators who are highly skilled. Unskilled operators have been observed to manipulate a dozing blade or otherwise operate a tractor such that the tractor stalls while attempting to form a slot in a substrate. In other instances, rather than stalling the tractor, unskilled operators can sometimes cut a slot that is too shallow than what is theoretically possible, or even skim the dozing blade across a surface of the substrate without loosening any substantial amount of material over at least a portion of a given pass. Stalling the machine, or removing too little material, understandably impacts efficiency. For these and other reasons, there remains a premium in the pertinent industries on sophisticated equipment design and operation, as well as operator skill.

U.S. Pat. No. 3,238,648 to D. E. Cobb et al. is directed to a bulldozer with a stinger bit, for the apparent purpose of enabling a reasonably deep cut through hard material without overtaxing the tractor engine and tractive ability. These goals are apparently achieved by making the stinger bit adjustable or retractable, such that it can be used to ease initial penetration. This design would apparently enable a normal use of the full width of the blade, and an alternative use with the stinger bit extended. While Cobb et al. may have provided advantages over the state of the art at that time, there remains ample room for improvement. Moreover, the features necessary to enable the functionality of the stinger bit, such as hydraulic actuators and the like, can add non-trivial expense, complexity and maintenance requirements to the machine.

SUMMARY

In one aspect, a dozing blade assembly for a tractor includes a dozing blade having a first and a second outboard wing, a forwardly located moldboard extending between the first and second outboard wings, and a plurality of rearwardly located push-arm mounts, for coupling the dozing blade assembly with push-arms of the tractor. The dozing blade further includes an upper and a lower edge, and a material molding surface located in part on the moldboard, and in part on each of the first and second outboard wings, the material molding surface having a concave vertical profile extending between the upper and lower edges, and a concave horizontal profile. The assembly further includes a cutter mounted to the dozing blade and having a proximal edge positioned adjacent the material molding surface, a distal edge, and a compound digging face extending between the proximal edge and the distal edge. The compound digging face has a center segment oriented at a steep angle relative to a horizontal plane, and a first and a second outer segment adjoining the center segment and each being oriented at a shallow angle relative to the horizontal plane.

In another aspect, a cutter for a dozing blade assembly includes an elongate multi-piece body having a plurality of body sections each defining a plurality of bolting holes communicating between a front digging face and a back mounting face, and being configured to receive a plurality of bolts for mounting the plurality of body sections in a service configuration upon a planar mounting surface of a dozing blade coupled with a tractor. The plurality of body sections each include a proximal edge and a distal edge, and a length extending parallel the proximal and distal edges, and further defining a face angle between the corresponding digging and mounting faces in a plane oriented normal to the corresponding length. The plurality of body sections further include a middle body section, and a first and a second outer body section, and the length of the middle body section is from one-third to two-thirds of a sum of the lengths of the middle, first, and second body sections. The face angle of the middle body section is different from the face angle of each of the first and second body sections, such that in the service configuration the digging face of the middle body section is more steeply inclined than the digging face of the first and second body sections relative to an underlying substrate.

In still another aspect, a method of dozing with a tractor includes moving the tractor in a forward direction such that a cutter mounted to a dozing blade of the tractor advances through material of a substrate. The method further includes inducing failure of the substrate during the advancement, via a steeply oriented middle section and shallowly oriented outer sections of the cutter, and sliding material loosened from the substrate via the induced failure in an upward direction across a material molding surface of the dozing blade.

DETAILED DESCRIPTION

Figure 1:
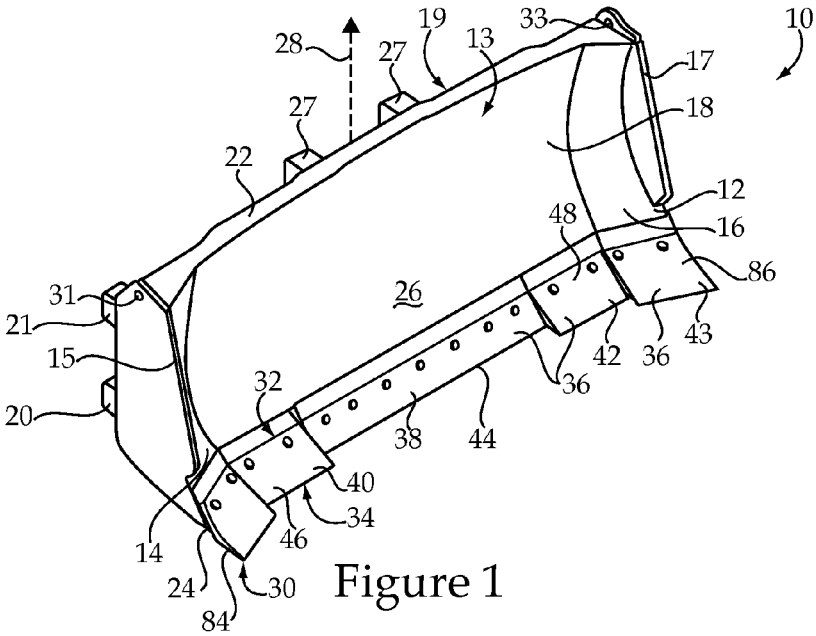
FIG. 1 is a diagrammatic view of a dozing blade assembly having a cutter, according to one embodiment.

Referring to FIG. 1, there is shown a dozing blade assembly 10 for a tractor, according to one embodiment. Assembly 10 may include a dozing blade 12 having a front side 13, a back side 19, a first outboard wing 14 and a second outboard wing 16. A forwardly located moldboard 18 extends between first and second outboard wings 14 and 16. Blade 12 further includes a first side plate 15 and a second side plate 17 positioned outboard of and coupled to wings 14 and 16. A plurality of rearwardly located push-arm mounts 20, one of which is diagrammatically shown, are positioned at back side 19, for coupling assembly 10 with push-arms of a tractor. A plurality of tilt actuator connectors 21 are likewise positioned at back side 31, in a conventional manner. Blade 12 further includes an upper edge 22 and a lower edge 24. A material molding surface 26 is located in part on moldboard 18, and in part on each of wings 14 and 16 and extends from side plate 15 to side plate 17. Material molding surface 26 has a concave vertical profile extending between upper and lower edges 22 and 24, and a concave horizontal profile. Blade 12 may further include a first lifting eye 31 and a second lifting eye 33 located upon, within or proximate side plates 15 and 17, near back side 19, for coupling blade 12 with a tractor in a conventional manner. A plurality of lift actuator connectors 27 are positioned along upper edge 22. Although it is contemplated that assembly 10 may be configured for lifting and lowering, tilting, and possibly pivoting when coupled with the tractor, the present disclosure is not thereby limited. Blade 12 defines a generally vertical axis 28, located mid-way between connectors 27. As will be further apparent from the following description, assembly 10 is uniquely configured for balancing the relative ease with which assembly 10 penetrates material of a substrate with the relative ease with which assembly 10 may be pushed forward through the substrate, to optimize dozing efficiency.

To this end, assembly 10 may further include a cutter 30 mounted to blade 12 and having a trailing or proximal edge 32 positioned adjacent material molding surface 26, and a leading or distal edge 34. Cutter 30 may further include a compound digging face 36 extending between proximal edge 32 and distal edge 34. Digging face 36 includes a center segment 38 oriented at a steep angle relative to a horizontal plane, for example the plane of the page in FIG. 1 which is approximately normal to axis 28. Digging face 36 may further include a first outer segment 40 and a second outer segment 42 adjoining center segment 38. Each of segments 40 and 42 may be oriented at a shallow angle relative to the horizontal plane. The differently oriented digging faces, or digging face segments, enable balancing downward penetrability with forward pushability of assembly 10 through material of a substrate. The terms "steep" and "shallow" are used herein in comparison with one another, and relative to the horizontal plane. The horizontal plane may be self-defined by assembly 10 based upon its service orientations. If assembly 10 were rested upon the ground on front side 13 or back side 19, the "horizontal" plane would extend transverse to the ground surface. Where rested approximately as shown in FIG. 1, the horizontal plane is substantially the same as a horizontal plane that would be defined by the underlying substrate upon which assembly 10 is resting. Horizontal and vertical directions or orientations may also be understood in reference to the vertical and horizontal terms used in describing the concave profiles of surface 26.

Cutter 30 may include an elongate, multi-piece body 43 having a middle body section 44, a first outer body section 46 and a second outer body section 48. Middle body section 44 may have center segment 38 of digging face 36 located thereon, whereas first and second outer body sections 46 and 48 may have first and second outer segments 40 and 42, respectively, of digging face 36 located thereon. Each of segments 38, 40 and 42 might also be understood independently as a "digging face," but are referred to herein as segments for ease of description. Cutter 30 may still further include a first end plate 84 and a second end plate 86 aligned with first and second outboard wings 14 and 16, respectively. Middle body section 44 and outer body sections 46 and 48 may extend between first and second end plates 84 and 86 and are aligned with moldboard 18. End plates 84 and 86 may have the form of end "bits" in certain embodiments, comprising a casting or forging having a shape other than a simple plate. The present disclosure is not limited to any particular end plate or bit configuration, and different styles may suit different dozing applications.

Figure 2:
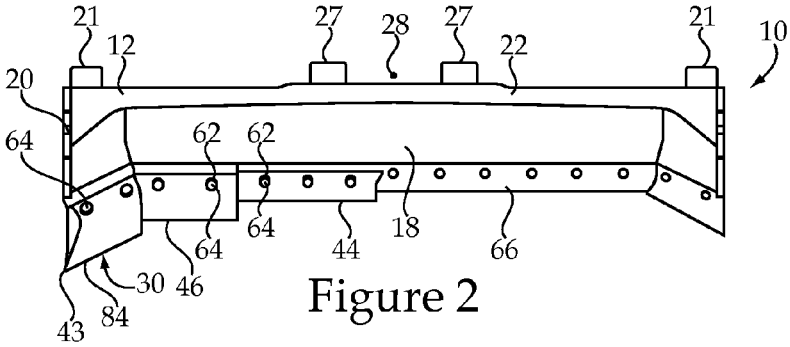
FIG. 2 is a top view of the dozing blade assembly of FIG. 1.

Referring now to FIG. 2, there is shown a top view of assembly 10, in partial cut-away where body section 42, end plate 86 and part of body section 44 are not shown, and illustrating a planar mounting surface 66 of blade 12. Another planar mounting surface (not numbered) is shown adjacent surface 66, for mounting end plate 86. The portions of blade 12 obscured by cutter 30 in FIG. 2 are configured similarly to those visible. Also shown in FIG. 2 are a plurality of bolts 64 extending through a bolting holes 62. In a practical implementation strategy, each of middle body section 44 and first and second outer body sections 46 and 48 may define a plurality of bolting holes 62 passing therethrough, such that bolts 64 may couple cutter 30 to blade 12, in particular being received in registering bolting holes in blade 12. End plates 84 and 86 may similarly define a plurality of bolting holes for analogous purposes.

Figure 3:
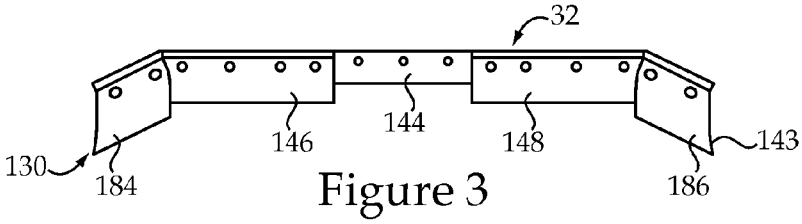
FIG. 3 is a top view of a cutter, according to another embodiment.
Figure 4:
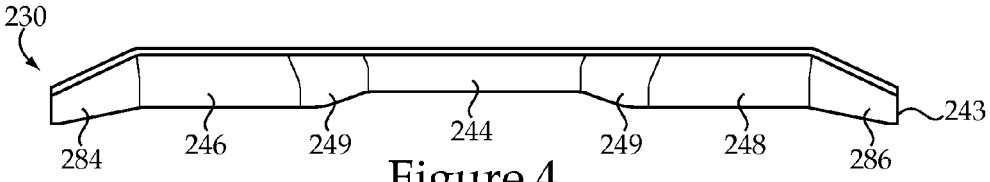
FIG. 4 is a top view of a cutter, according to yet another embodiment.

Referring now to FIG. 3, there is shown a cutter 130 according to another embodiment, and having a middle body section 144, outer body sections 146 and 148, and end plates 184 and 186. Each of the body sections may be part of an elongate multi-piece body 143, similar to elongate body 43, but differing with respect to the relative lengths of the respective body sections. It will be noted that a length of middle body section 144 relative to sections 146 and 148 is relatively less than the length of middle body section 44 relative to sections 46 and 48 in the foregoing embodiment. Thus, the middle section of a cutter according to the present disclosure may be either longer or shorter than the corresponding outer sections. FIG. 4 illustrates yet another embodiment of a cutter 230, including an elongate body 243, having a middle body section 244, outer body sections 246 and 248, and end plates 284 and 286. Rather than a multi-piece body, cutter 230 is configured as a single piece body. Cutter 230 also includes first and second transition sections 249 extending between middle body section 244 and outer body sections 246 and 248. It is contemplated that many embodiments according to the present disclosure may be configured as retrofit kits, where individual body sections are coupled with a mounting surface of a dozing blade in place of a conventionally designed cutter. This is so primarily because cutters used in dozing blades may be quite heavy, and a single-piece version could be more difficult to handle and install, as well as manufacture. It is nevertheless contemplated that a single-piece body designs may fall within the scope of the present disclosure.

Figure 5:
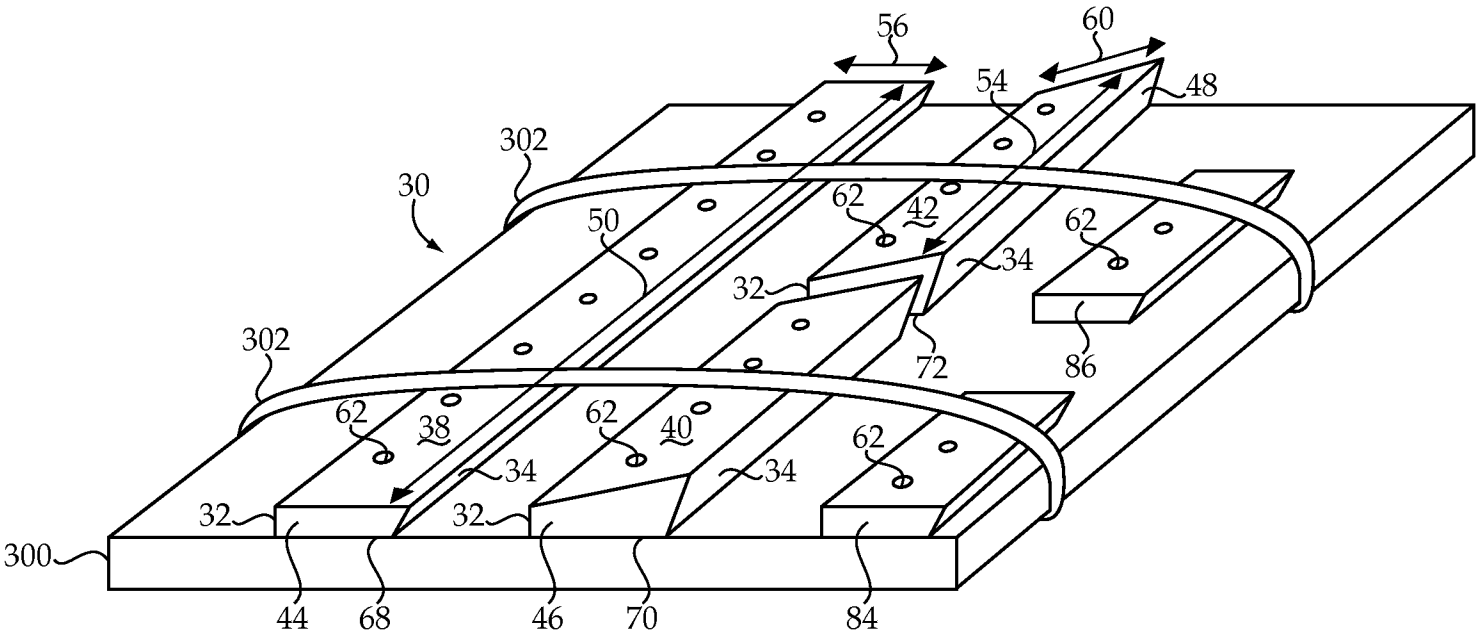
FIG. 5 is a diagrammatic view of a cutter, prepared for shipping, according to one embodiment.

Referring now also to FIG. 5, there is shown cutter 30 disassembled and packaged upon a pallet 300 via securing straps or the like 302, as it might appear where cutter 30 is prepared to be shipped for service. As noted above, lengths of certain of the components of cutter 30, and other embodiments contemplated herein, may be varied from the relative lengths and aspect ratios shown in the embodiments of FIGS. 1-4. In FIG. 5, reference numeral 50 indicates a length of middle body section 44 extending from one end to an opposite end thereof, and generally parallel edges 32 and 34. Length 50 may be from two feet to twelve feet, and in certain embodiments from four feet to eight feet. Reference numeral 54 indicates a length of outer section 48. Outer sections 46 and 48 may, in at least most embodiments, be equal in length and width to one another. A width of middle body section 44 is indicated with reference numeral 56, whereas a width of outer body section 48 is indicated with reference numeral 60. Each of widths 56 and 60 may be defined as the width of the respective digging face segment in a direction normal to the corresponding lengths. In a practical implementation strategy, length 50 may be from one-third to two-thirds of a sum of lengths 50, 54, and the corresponding length of section 46. Width 56 may be less than width 60, and length 50 may be greater than width 56 by a factor of four or greater.

As noted above, dozing blade 12 may include planar mounting surface 66 extending along lower edge 24 between wings 14 and 16. Each of middle, first, and second body sections 44, 46 and 48 may include a back mounting face 68, 70 and 72, respectively, which contacts mounting surface 66 when cutter 30 is assembled in a service configuration upon blade 12 as shown in FIG. 1. Each of back mounting faces 68, 70 and 72 may be planar. It may also be noted from FIG. 5 that each of body sections 44, 46 and 48 may define a generally polygonal cross-section, as may end plates 84 and 86. In the illustrated embodiment, body section 44 and end plates 84 and 86 may each be formed from a flat piece of rolled steel, whereas outer sections 46 and 48 may be cast or forged, for instance. In the FIG. 5 embodiments, end plates 84 and 86 have parallel front digging and back mounting faces. Also illustrated in FIG. 5 are bolting holes 62. It may be noted that bolting holes 62 may be arranged in a pattern defining a straight line extending generally parallel edges 32 and 34 of cutter 30, along each of body sections 44, 46 and 48. Bolting holes 62 may be located relatively closer to proximal edge 32 than to distal edge 34, although the present disclosure is not thereby limited. Bolting holes 62 formed in end plates 84 and 86 may be arranged in a similar pattern.

Figure 6:
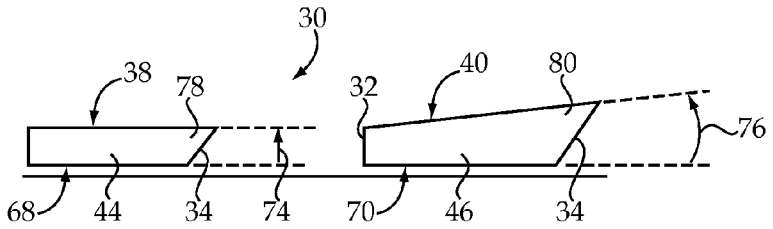
FIG. 6 is an end view of two sections of the cutter of FIG. 5.

Turning now to FIG. 6, there is shown an end view of body section 44 and body section 46 as they might appear when back mounting faces 68 and 70 are positioned in a common plane, such as when resting upon pallet 300 or a horizontal ground surface. Although body section 48 is not shown in FIG. 6, since it may be substantially identical to body section 46, or a mirror image thereof, the present description should be understood to similarly apply. Body section 44 may define a first face angle 74 between center segment 38 of digging face 36 and back mounting face 68, the face angle lying in a plane normal to length 50. Body section 46 may define a second face angle 76 between outer segment 40 of digging face 36 and back mounting face 70, in an analogous plane. Second face angle 76 is greater than first face angle 74 in the FIG. 6 embodiment. In a practical implementation strategy, a difference between second face angle 76 and first face angle 74 may be about 30°, or less, and may be equal to about 20° in certain embodiments. In the FIG. 6 embodiment, the respective segments of digging face 36 and mounting face 70 upon section 44 are parallel. In other embodiments, parallel digging and mounting face segments are instead located on the outer body sections, and the middle body section may include non-parallel digging and mounting faces, as discussed below.

Figure 7:
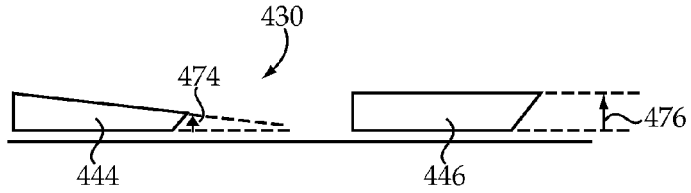
FIG. 7 is an end view of two sections of a cutter, according to another embodiment.
Figure 8:
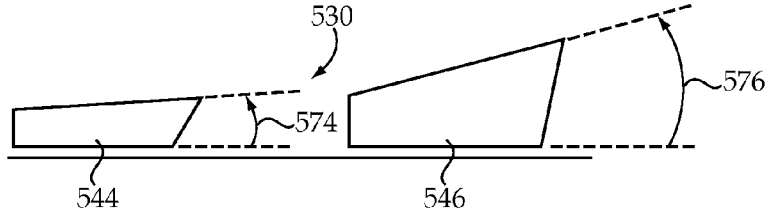
FIG. 8 is an end view of two sections of a cutter according to yet another embodiment.

Referring to FIG. 7, there is shown yet another embodiment of a cutter 430 according to the present disclosure. Cutter 430 includes a middle body section 444 and an outer body section 446, and will be understood to include another outer body section which is not shown in FIG. 7. In cutter 430, middle body section 444 defines a first face angle 474, whereas outer body section 446 defines a second face angle 476. It may be noted that in cutter 30, as shown in FIG. 6, middle body section 44 is flat, such that angle 74 is equal to approximately zero. In such an embodiment, angle 76 might be between zero and 30°. In the embodiment of FIG. 7, analogously defined first face angle 474 may be greater than zero, and second face angle 476 may be approximately zero. FIG. 8 illustrates yet another cutter 530, in which neither of a middle section 544 nor an outer section 546 defines a face angle equal to zero. Instead, a first face angle 574 defined by middle section 544 may have a first size, and a second face angle 576 may have a second, greater size which is between the value of face angle 574 and face angle 574 plus 30°.

As further discussed below, certain advantageous properties of the present disclosure relate to how steeply the different sections of a cutter for a dozing blade assembly are oriented relative to the ground. Since dozing blades themselves may have varying geometry, the values of the various face angles discussed herein can vary substantially. While relatively small differences between face angles are contemplated herein, it should be noted that a difference between face angles of a middle body section and outer body sections which results from variations within manufacturing tolerances would not satisfy the intended understanding of "steep" versus "shallow." As noted above, the second face angle may be different from the first face angle, such that in a service configuration of cutter 30 and the other cutter embodiments contemplated herein, the digging face upon the middle body section is more steeply inclined than the digging face upon the outer body sections relative to an underlying substrate, and more particularly relative to a horizontal plane defined by the underlying substrate such as a plane of the ground surface. Typically, either middle body section 44, or both of outer body sections 46, will be flat such that the corresponding face angle is zero, although as illustrated in FIG. 8 alternatives are contemplated. Except where a dozing blade mounting surface is purpose-built to obtain different effective face angles in service, or some other modification, such as wedge-shaped shims, is used, body sections 44, 46, 48 will not all be flat and define face angles of zero.

Figure 9:
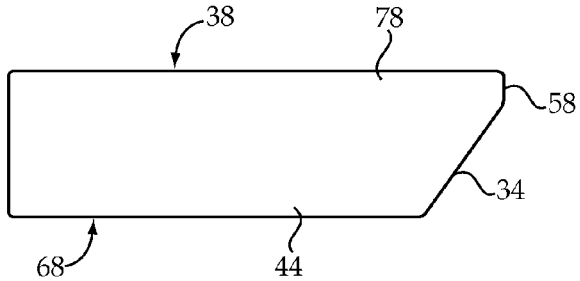
FIG. 9 is an enlarged end view of one section of the cutter of FIGS. 5 and 6.

Referring now to FIG. 9, there is shown an enlarged view of middle body section 44, and illustrating a relief surface 58 which is part of distal edge 34. It has been discovered that a relieved profile such as that imparted by forming relief surface 58 can assist in achieving initial penetration into a substrate, rather than a tendency for the cutter to ski along the surface of the substrate. Relief surface may extend a distance between faces 38 and 68 which is up to about 50% of a thickness between faces 38 and 6. Other sections of cutter 30 may have similar relief surfaces. Returning to FIG. 6, it may be noted that middle body section 44 includes a distally narrowing taper 78, and that distal edge 34 is located upon the distally narrowing taper 78. Outer body section 46 also includes a distally narrowing taper 80, and the corresponding portion of distal edge 34 is also located on the distally narrowing taper 80.

INDUSTRIAL APPLICABILITY

Figure 10:
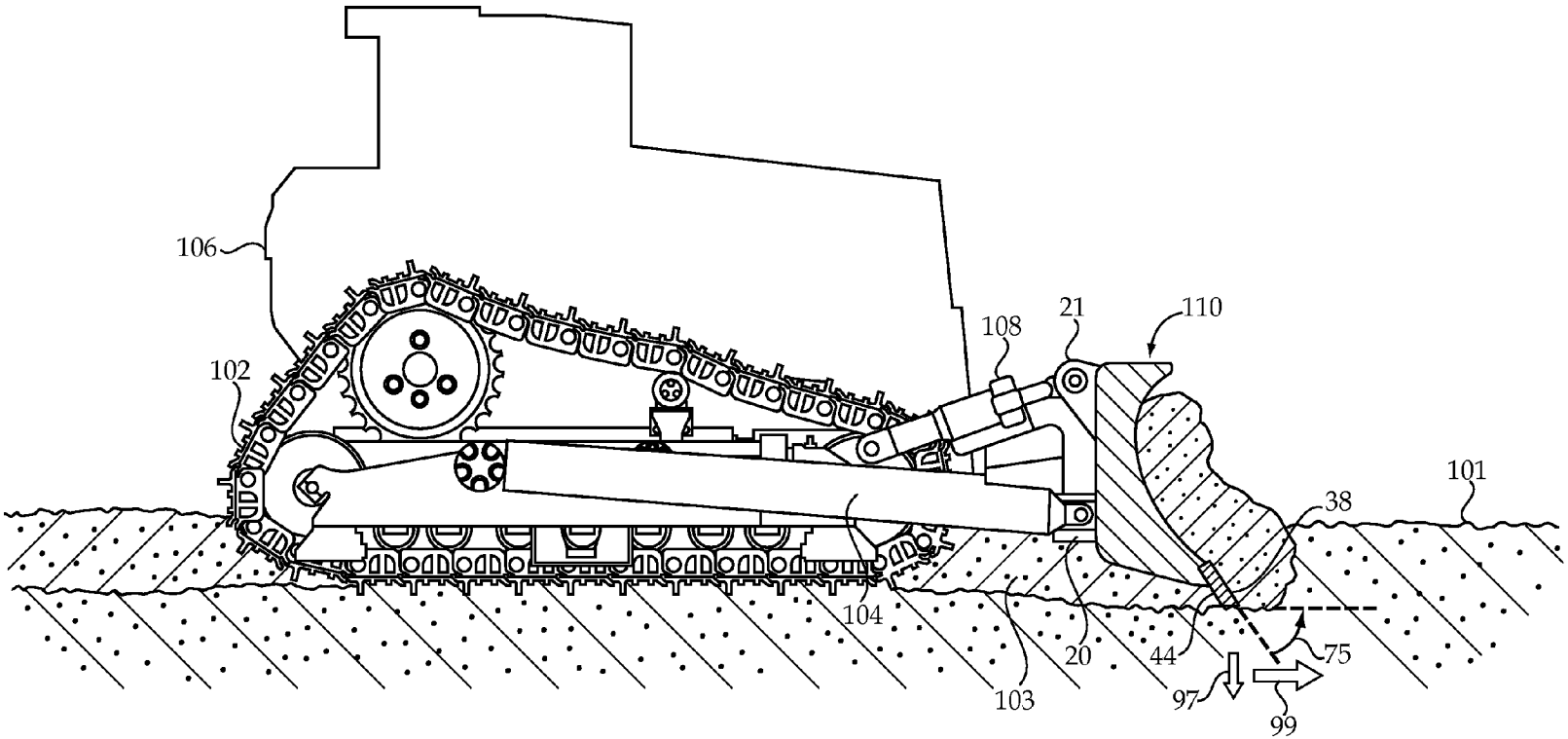
FIG. 10 is a side diagrammatic view of a tractor at one stage of a dozing process, according to one embodiment.
Figure 11:
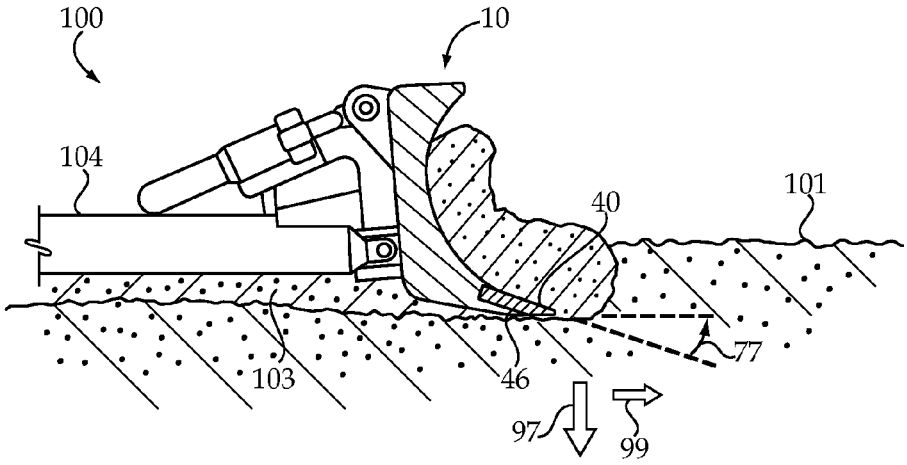
FIG. 11 is a side diagrammatic view of the tractor of FIG. 10, at another stage of the dozing process.

Referring to FIGS. 10 and 11, there is shown a track-type tractor 100 having a track 102 coupled with a frame 106. A dozing blade assembly 10 is coupled with a set of push-arms 104 of tractor 100, and a tilt actuator 108. No lift or pivot actuators are shown, although tractor 100 might be thusly equipped. In FIG. 10, dozing blade assembly 10 is shown in a sectioned view as it might appear where the section plane passes vertically through assembly 10 approximately at a horizontal centerpoint, such that middle body section 44 is visible within a slot 103 being formed in a substrate 101. In FIG. 11, assembly 10 is shown sectioned as it might appear where the section plane passes vertically through assembly 10 such that outer body section 46 is visible. Digging face segment 38 of middle body section 44 is oriented at a steep angle 75 relative to a horizontal plane, for example from about 40° to about 55°. Digging face segment 40 of outer body section 46 is more shallowly oriented relative to the horizontal plane at an angle 77 which is from about 25° to about 45°.

It will be recalled that face angles 74 and 76 may differ from one another by about 30° or less. Thus, in an embodiment where angle 77 is about 25° and angle 75 is about 55°, at the respective upper and lower extremes of the disclosed ranges, the difference between face angles 74 and 76 may be about 30°. Other values for angles 77 and 75 between the extremes of the described ranges may yield differences between face angles 74 and 76 which are less than 30°. While the disclosed ranges for angles 77 and 75 overlap, those skilled in the art will appreciate in view of the other teachings herein that face angles 74 and 76 will typically not be equal, or otherwise selected such that the steeper versus shallower orientations of the respective digging face segments in service are not obtained. The term "about" is used herein in the context of rounding to a consistent number of significant digits. Accordingly, "about 40°" means from 35° to 44°, "about 35°" means from 34.5° to 35.4°, and so on.

It will be recalled that the different orientations of digging face segment 38 versus digging face segments 40 and 42 may be configured to balance downward penetrability with forward pushability of cutter 30, and thus dozing blade assembly 10, through material of a substrate. To this end, in FIG. 10, a relatively small vertical arrow 97 is shown, versus a relatively large horizontal arrow 99. The difference in sizes of arrows 97 and 99 may be understood to represent the relative ease with which body section 44 can be urged through material of substrate 101 in the respective directions. In FIG. 11, vertical arrow 97 is relatively large, whereas horizontal arrow 99 is relatively small, representing the relative ease with which section 46 may be urged through material of substrate 101 in the respective directions. Another way to understand the principles illustrated in FIGS. 10 and 11 is that body section 44 may be urged vertically through material of substrate 101 relatively easily, but with more difficulty urged horizontally through the material. In contrast, section 46 may be more difficult to urge in a vertical direction, but easier to urge in a horizontal direction.

As tractor 100 is moved in a generally forward direction, left to right in FIGS. 10 and 11, slot 103 may be formed in substrate 101, by inducing failure of substrate 101, and such that material loosened via the induced failure flows in a generally upward direction across the material molding surface of the dozing blade, and is ultimately pushed in a forward direction via the movement of tractor 100. This will generally occur, based on the differently oriented digging face segments of cutter 30, and without any adjustment to a tilt angle of assembly 10, such that the likelihood of stalling or skimming the dozing blade and/or tractor is reduced. As noted above, angle 75 may be from about 40° to 55°, and angle 77 may be from about 25° to about 45°. In a further practical implementation strategy, angle 75 may be equal to about 53°, and angle 77 may be equal to about 30°. In forming slot 103, failure of substrate 101 may be induced via shattering, in contrast to other digging techniques such as scraping, in which a ribbon of material is sliced off.

Figure 12:
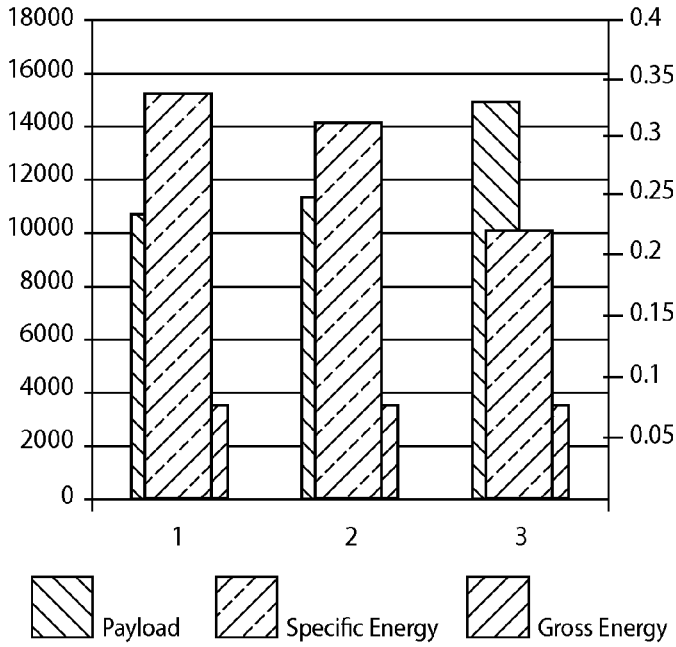
FIG. 12 is a bar chart illustrating certain dozing parameters for a dozing blade assembly according to the present disclosure, in comparison with other designs.

Referring now to FIG. 12, there is shown data via a bar chart reflecting payload, specific energy, and gross energy for a first dozing blade assembly 1, a second dozing blade assembly 2, and a third dozing blade assembly 3. The data in FIG. 12 are full scale data derived from scale model laboratory testing. Dozing blade assemblies 1 and 2 represent dozing blades having a cutter with a design different from the designs of the present disclosure, and in particular having a middle body section and outer body sections which are not differently oriented, in other words extending straight across the front of the dozing blade assembly and having digging faces in a common plane. Assembly 3 represents data which might be expected to be obtained with a dozing blade having the differently oriented digging face segments, i.e. steep middle and shallow outer, of the present disclosure. Each of assemblies 1, 2 and 3 was passed through material having scaled down soil properties until the maximum payload capacity was obtained. The units shown on the left side of FIG. 12 represent payload in kilograms of material. It may be noted that a payload with dozing blade assembly 1 is slightly greater than 10,000 kilograms, whereas a payload with dozing blade assembly 2 is slightly more than 11,000 kilograms. A payload using dozing blade assembly 3 is approximately 15,000 kilograms, representing an increase in payload of at least 25% over the other designs. Gross energy is generally less with dozing blade assembly 3 than with either of dozing blade assemblies 1 and 2. With regard to specific energy, which includes a quantity of energy consumed per unit of material moved such as kilojoules per kilogram, and is perhaps the most useful metric of production dozing efficiency, it may be noted that dozing blade assembly 3 has a specific energy of about 0.225 as shown on the right side of FIG. 12, whereas dozing blade assemblies 1 and 2 each have a specific energy greater than 0.3 units of energy per unit mass of material, representing an efficiency advantage with the present design of at least 25%, and which is expected in certain instances to be at least 30%.

As discussed above, in earlier strategies production was often limited by either too great a tendency of the cutter of the dozing blade assembly to penetrate downward into material of a substrate, ultimately stalling the dozing blade assembly and tractor, or downward penetration was relatively more difficult and forward pushability was relatively easier, sometimes resulting in skimming the dozing blade assembly or cutting at too shallow a depth. In either case, it was typically necessary to perform a greater number of material removal passes, back up and repeat a pass when the tractor stalled, or simply accept the relatively low efficiency of the overall production dozing process. While operators may be able to manipulate the blade during dozing to lessen the likelihood of these problems, not all operators are sufficiently skilled to do this, nor are all dozing blades and tractors equipped to enable such techniques.

The present disclosure thus reflects the insight that the relative ease with which a cutter can be urged through material vertically versus horizontally can be balanced such that penetrability and pushability are optimized, to in turn optimize production. This is achieved without the need for adjustable and relatively complex systems such as Cobb, discussed above. While certain other known strategies claim to achieve increased production dozing efficiency by way of specialized blade and/or moldboard configurations, the present disclosure achieves increased efficiency by way of features of the cutter, and is thus applicable to many different types of blades.

From the foregoing description, it will further be appreciated that many combinations of cutter body section geometry can yield a cutter for a dozing blade assembly having the desired characteristics. The specific geometry chosen, such as the size of the face angles of the respective body sections may be tailored to suit the geometry of the mounting face on the dozing blade to which the cutter is to be mounted. Various parameters of a cutter may also be tailored based upon the intended service applications. For very tough substrates, such as rock, the middle section of the cutter may be designed such that the center section of the digging face is both relatively steep with respect to an underlying substrate and relatively long. For very soft substrates, such as certain sandy soils, the middle section may be designed such that the center segment of the digging face is both relatively shallow and relatively short. For substrates of intermediate toughness, the inclination of the center segment may be medium, as may its length.

It should further be appreciated that body section length and digging face inclination are factors which can be independently varied. Thus, for a given steepness of the center digging face segment, a relatively longer length of the middle body section can yield greater penetrability and lesser pushability, whereas a relatively shorter length can yield lesser penetrability and greater pushability. As noted above, a length of the middle body section which is from one-third to two-thirds of the sum of the lengths of the middle and outer body sections, may be sufficient to cause the interaction of the cutter with material of a substrate to be determined by both the middle body section and the outer body sections. Where the length of the middle body section is less than one-third of the sum of the lengths of the three sections, the balance between pushability and penetrability of the cutter, may be determined too much by the outer body sections. Where the length of the middle body section is greater than two-thirds of the sum of the lengths of the three sections, that balance may be determined too much by the middle body section. Another way to understand these principles is that the middle body section should not be made so short relative to the other body sections that it has only a minimal effect on the dozing behavior of the cutter, nor so long that the middle body section overwhelmingly determines the behavior of the cutter. With regard to varying steepness of the digging face on the middle body section, if made steeper than the generally range disclosed herein, the reduced pushability may be problematic, whereas if made too shallow, the cutter may fail to penetrate. As to the difference in inclination between the respective digging face segments in the service configuration, if made too large the cutter may have too much overall resistance to moving through a substrate, and thus neither optimum pushability nor optimum penetrability.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A dozing blade assembly for a tractor comprising:

a dozing blade including a first and a second outboard wing, a forwardly located moldboard extending between the first and second outboard wings, and a plurality of rearwardly located push-arm mounts, for coupling the dozing blade assembly with push-arms of the tractor;

the dozing blade defining a vertical axis and further including an upper and a lower edge, and a material molding surface located in part on the moldboard, and in part on each of the first and second outboard wings, the material molding surface having a concave vertical profile extending between the upper and lower edges, and a concave horizontal profile;

a cutter mounted to the dozing blade and having a proximal edge positioned adjacent the material molding surface, a distal edge, and a compound digging face extending between the proximal edge and the distal edge; and the compound digging face having a center segment oriented at a steep angle of vertical inclination relative to a horizontal plane located beneath the dozing blade and oriented normal to the vertical axis, and a first and a second outer segment adjoining the center segment and each being oriented at a shallow angle relative to the horizontal plane.

2. The assembly of claim 1 wherein the cutter includes an elongate multi-piece body including a middle body section having the center segment of the compound digging face located thereon, and a first and a second outer body section having the first and second outer segments of the compound digging face, respectively, located thereon.

3. The assembly of claim 2 wherein a length of the middle body section is from one third to two thirds of a sum of the length of the middle, first, and second body sections, and wherein a width of the middle body section is less than widths of each of the first and second body sections.

4. The assembly of claim 3 wherein:

each of the middle, first, and second body sections defines a plurality of bolting holes passing therethrough, and further comprising a plurality of bolts extending through the plurality of bolting holes and coupling the cutter to the dozing blade; and the dozing blade further includes a planar mounting surface extending along the lower edge between the first and second outboard wings, and wherein each of the middle, first, and second body sections includes a back mounting face contacting the planar mounting surface.

5. The assembly of claim 4 wherein the middle body section defines a first face angle between the center segment of the digging face and the corresponding back mounting face, and each of the first and second body sections defines a second, different face angle between the respective first and second outer segments of the digging face and the corresponding back mounting faces.

6. The assembly of claim 5 wherein a difference between the second face angle and the first face angle is about 30°, or less.

7. The assembly of claim 6 wherein each of the middle, first, and second body sections includes a distally narrowing taper having the distal edge of the cutter located thereon.

8. The assembly of claim 2 wherein the cutter further includes a first end plate and a second end plate aligned with the first and second outboard wings, respectively, and wherein the middle, first, and second body sections extend between the first and second end plates and are aligned with the moldboard.

9. A cutter for a dozing blade assembly comprising:

an elongate multi-piece body having a plurality of body sections each defining a plurality of bolting holes communicating between a front digging face and a back mounting face, and being configured to receive a plurality of bolts for mounting the plurality of body sections in a service configuration upon a planar mounting surface of a dozing blade coupled with a tractor;

the plurality of body sections each including a proximal edge and a distal edge, and a length extending parallel the proximal and distal edges, and further defining a face angle between the corresponding digging and mounting faces in a plane oriented normal to the corresponding length;

the plurality of body sections further including a middle body section, and a first and a second outer body section, and the length of the middle body section being from one-third to two-thirds of a sum of the lengths of the middle, first, and second body sections; and the face angle of the middle body section being different from the face angle of each of the first and second body sections, such that in the service configuration the digging face of the middle body section is more steeply inclined than the digging face of the first and second body sections relative to an underlying substrate.

10. The cutter of claim 9 wherein a difference between the face angle of the middle body section and the face angle of the first and second body sections is about 30° or less.

11. The cutter of claim 10 wherein the difference between the face angles is equal to about 20°, and wherein the length of the middle section is from 2 feet to twelve feet.

12. The cutter of claim 10 wherein one of the middle, first, and second body sections, includes parallel digging and mounting faces.

13. The cutter of claim 12 wherein the middle body section includes the parallel digging and mounting faces.

14. The cutter of claim 11 wherein each of the middle, first, and second body sections, includes a distally narrowing taper, such that the corresponding distal edge is located upon the distally narrowing taper.

15. The cutter of claim 14 further comprising a first and a second end plate positionable outboard of the first and second body sections, in the service configuration.

16. The cutter of claim 15 wherein the first end plate and the second end plate each include a planar front digging face and a planar back mounting face.

17. A method of dozing with a tractor comprising the steps of:

moving the tractor in a forward direction such that a cutter mounted to a dozing blade of the tractor advances through material of a substrate extending horizontally beneath the tractor;

inducing failure of the substrate during the advancement via a middle section of the cutter steeply oriented relative to a horizontal plane, and via outer sections of the cutter shallowly oriented relative to the horizontal plane; and sliding material loosened from the substrate via the induced failure in an upward direction across a material molding surface of the dozing blade.

18. The method of claim 17 wherein the steeply oriented middle section has a length which is from one-third to two-thirds of a sum of lengths of the middle and outer sections.

19. The method of claim 18 wherein the middle section has a front digging face oriented at an angle relative to a horizontal plane defined by the substrate which is from about 40° to about 55°, and the outer sections have front digging faces oriented at shallow angles relative to the horizontal plane which are from about 25° to about 45°.

20. The method of claim 19 wherein the step of inducing further includes shattering the substrate, and further comprising a step of pushing the loosened material in a forward direction via the movement of the tractor such that a slot is formed in the substrate.

* * * * *